United States Patent [19]

Shannon

[11] Patent Number: 4,882,097

[45] Date of Patent: Nov. 21, 1989

[54] CARBONATION SYSTEM

[75] Inventor: Joseph W. Shannon, Kent, Ohio

[73] Assignee: ABC/Sebrn Tech Corp., Mogadore, Ohio

[21] Appl. No.: 240,690

[22] Filed: Sep. 6, 1988

[51] Int. Cl.[4] ..... B01F 3/04

[52] U.S. Cl. ..... 261/35; 261/67; 261/DIG. 7; 261/DIG. 74

[58] Field of Search ..... 261/35, DIG. 7, DIG. 74, 261/67

[56] References Cited

U.S. PATENT DOCUMENTS

| | | | |
|---|---|---|---|
| 2,782,016 | 2/1957 | Iannelli | 261/DIG. 7 |
| 2,809,597 | 10/1957 | Fowler | 261/35 |
| 3,323,783 | 6/1967 | Schwertfeger et al. | 261/35 |
| 3,552,726 | 1/1971 | Kraft | 261/DIG. 7 |
| 3,583,601 | 6/1971 | Ayers | 261/DIG. 7 |
| 4,708,827 | 11/1987 | McMillin | 261/35 |

*Primary Examiner*—Tim Miles

*Attorney, Agent, or Firm*—Renner, Kenner, Greive, Bobak, Taylor & Weber

[57] ABSTRACT

A carbonation system employing a pneumatic pump which operates off of a pressurized source of carbon dioxide which is itself employed for the carbonation process. The pneumatic pump serves as both a precarbonation chamber and a reservoir for receiving water from a low pressure source and subsequently transferring precarbonated water to a carbonation tank. Sensors within the pneumatic pump assure that a proper volume of water is maintained within the precarbonation chamber and available for transfer to the tank. Both the pneumatic pump and the carbonation tank operate off of the same supply of pressurized carbon dioxide, but the pressure provided to the tank is slightly less than that presented to the pneumatic pump.

20 Claims, 1 Drawing Sheet

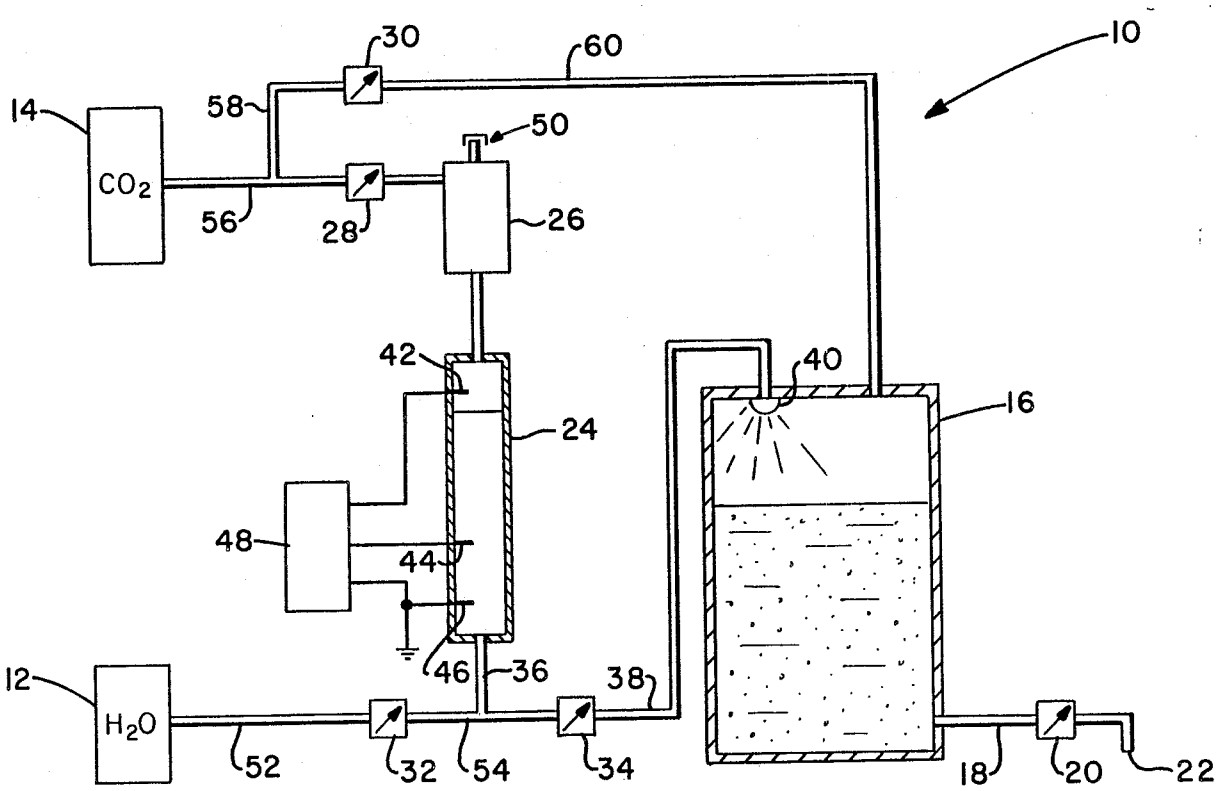
10
16
22
20
18
40
60
38
34
50
26
24
36
54
46
42
44
30
28
32
58
56
48
52
$CO_2$
$H_2O$
14
12

CARBONATION SYSTEM

TECHNICAL FIELD

The invention herein resides in the art of beverage dispensing apparatus and, more particularly, to carbonators use in carbonating water by pressurizing the water under a head of carbon dioxide gas. Specifically, the invention relates to an apparatus for generating soda water by entraining carbon dioxide gas in water.

BACKGROUND ART

Carbonators and carbonation systems are old and commonly used. While such systems are particularly used in soft drink dispensers, it is also known that many individuals simply enjoy drinking carbonated water or soda whether flavored or not. Such soda is commonly generated by introducing a pressure head of carbon dioxide gas onto a reservoir of water in such a manner as to entrain the carbon dioxide gas in the water. It is known in the art that a pressure head of carbon dioxide gas on the order of 75 psi is sufficient to generate soda from water when the water is at a temperature of approximately 70°. At such a temperature and pressure, the water and carbon dioxide gas will stabilize or saturate at a suitable level to obtain a desired taste. However, the level of saturation is indeed a function of both temperature and pressure.

Prior art carbonators have typically required the implementation of a motor to drive water under pressure into a tank having a pressure head on the order of 100 psi. The motor must be of sufficient size to overcome the tank pressure of the carbonator and, consequently, results in the generation of unwanted heat. The motor heat is transferred to the water which is to be carbonated, reducing the effectiveness of the carbonation process.

It is further known that carbonation tanks require the utilization of a float switch which is operative through relays and the like to actuate the motor upon demand to supply additional water to the carbonation tank. Such float switches are troublesome and, indeed, comprise a commonly-replaced element in the prior art carbonation systems.

The motor referenced above is employed to operate a pump for actually driving the water. The pump is typically of brass or stainless steel to operate in the food industry and must be of sufficient design criteria as to operate under high pressure. It has previously been known that such pumps often "burn out" when they are starved of water, for example, when the demands of the water supply to the operating environment reduce the amount of water available to the carbonation system to an insufficient level. Indeed, the prior art teaches the utilization of expensive and unreliable methods of determining when the water supply is inadequate such that the motor and pump can be turned off. Such prior methods have included both thermal and pressure sensors.

Yet further, the prior art has taught the necessity of precooling tubing to be maintained between the pump and the tank such that the water introduced to the tank can be precooled in order that the carbonation process may be enhanced.

The foregoing structure and techniques of the prior art have been extremely expensive both in initial cost and in operation. The pump, motor, float switch and controlling circuitry are both expensive in implementation and costly in repair. Accordingly, there is a need in the art for a carbonation system which can operate without electrical motors, high pressure pumps, high power control circuitry, float switches and the requisite maze of precooling tubing.

DISCLOSURE OF INVENTION

In light of the foregoing, it is a first aspect of the invention to provide a carbonation system which eliminates the necessity of electrical motors, pumps, float switches, and precooling coils. It is a further aspect of the invention to provide a carbonation system which operates with a pneumatic pump.

Still a further aspect of the invention is the provision of a carbonation system in which the supply pressure for the water to the system may simply be the low pressure at which the water is supplied to the establishment in which the carbonation system is employed.

Yet another aspect of the invention is the provision of a carbonation system which includes a precarbonation chamber, precarbonating the water before introduction into a carbonation tank.

Still another aspect of the invention is the provision of a carbonation system which eliminates the majority of the control circuitry and high power elements required in the prior art and which employes instead low power control logic.

An additional aspect of the invention is the provision of a carbonation system which is inexpensive to manufacture, easy to maintain, and readily adaptable for implementation in any of numerous ways.

The foregoing and other aspects of the invention which will become apparent as the detailed description proceeds are achieved by a carbonation system for generating soda, comprising: a source of carbon dioxide maintained under pressure; a source of water; a reservoir in communication with said source of carbon dioxide and said source of water, said reservoir receiving a volume of water from said source of water and a pressure head of carbon dioxide gas from said source of carbon dioxide; and a carbonation tank in communication with said source of carbon dioxide and said reservoir, said carbonation tank receiving a pressure head of carbon dioxide gas from said source of carbon dioxide and water from said reservoir.

Still further aspects of the invention are attained by a carbonation system for connection to a source of water, comprising: a source of carbon dioxide maintained at a pressure; a pneumatic pump in communication with the source of water and receiving water therefrom, and in communication with said source of carbon dioxide and receiving a first pressure head of carbon dioxide gas therefrom, said pressure head being greater than any pressure head associated with the source of water; and a carbonation tank in communication with said source of carbon dioxide and receiving a second pressure head of carbon dioxide gas therefrom, and in communication with said pneumatic pump and receiving water therefrom.

DESCRIPTION OF DRAWING

For a complete understanding of the objects, techniques and structure of the invention, reference should be had to the following detailed description and accompanying drawing wherein a schematic diagram of the carbonation system of the invention may be seen.

BEST MODE FOR CARRYING OUT INVENTION

Referring now to the drawing, it can be seen that a carbonation system according to the invention is designated generally by the numeral 10. The carbonation system 10 is adapted for interconnection with a water source 12 which may be any suitable source of water pressure such as a municipality water supply. Indeed, the water source 12 would comprise the inlet of water provided to any establishment in which the carbonation system 10 is to be employed. Also included as a portion of the system 10 is a pressurized source of carbon dioxide ($CO_2$). This pressurized source 14 may be of any suitable standard nature as is commonly known in the art and can be maintained at any suitable desired pressure. Typically, in such systems, the carbon dioxide at the source 14 will be maintained at a pressure on the order of 100 psi.

A carbonation tank 16 receives precarbonated water therein in a manner to be discussed hereinafter and maintains a reservoir of carbonated water or soda for eventual dispensing through a conduit 18. A suitable dispensing valve 20 is interposed in the conduit 18 and before a dispensing head 22. In a preferred embodiment of the invention, the dispensing valve 20 may be a solenoid-actuated valve, but the same could comprise a hand valve or any other suitable means.

Comprising an important feature of the invention is a pneumatic pump 24 which also serves as a precarbonation chamber in which water is precarbonated before transfer to the carbonation tank 16. The pneumatic pump 24 also serves as a low volume reservoir for temporarily housing and precarbonating the water before transfer to the tank 16. A three-way valve 26 is maintained at the top of the pneumatic pump 24 and in communication with the pressurized source of carbon dioxide 14. As will become apparent hereinafter, the valve 26 is operative to selectively vent the pump 24 to atmosphere or to allow communication from the carbon dioxide source 14 to the pump 24, thereby pressurizing such pump. A check valve 28 is interposed between the carbon dioxide source 14 and the three-way valve 26 to prevent any backflow to the source 14.

It will be seen that the pressurized source of carbon dioxide 14 communicates through a check valve 30 with the carbonation tank 16 to provide a pressure head of carbon dioxide gas in the top portion of the tank 16. The check valve 30 is of a unique nature in that it has associated therewith a finite cracking pressure in the forward direction. In a preferred embodiment, it is desired that the cracking pressure of the valve 30 be on the order of 20 psi such that the head introduced at the tank 16 is on the order of 80 psi. On the contrary, the check valve 28 and the valve 26 have no discernible cracking pressure and, accordingly, the pressure head provided to the pneumatic pump 24 is substantially the same as that provided by the source 14, preferably 100 psi. It will, of course, be appreciated by those skilled in the art that the check valve 30 might comprise a simple check valve with no discernible cracking pressure and that a pressure regulator might also be employed to reduce the pressure from the source 14 to the tank 16.

The water source 12 communicates to the pneumatic pump 24 through a check valve 32, again without a discernible cracking pressure. The pump 24 is operative to pass precarbonated water from the reservoir of the pump 24 through a check valve 34 to the tank 16. In standard fashion, the check valves 32,34 simply prevent backflow of water or carbonated water to either the water source 12 or the pump 24.

As shown, a single conduit or pipe 36 communicates with the bottom of the pneumatic pump 24 so as to provide a means for introducing fresh water into the pump 24 from the source 12 when the pump 24 is replenishing, and otherwise to urge precarbonated water from the pump 24 through the check valve 34 and conduit or pipe 38 to the tank 16. It will be noted that the introduction of this precarbonated water is through a spray nozzle 40 maintained at the top portion of the tank 16 and within the pressure head of carbon dioxide gas. The carbonation of the water is enhanced by the spraying or atomization of the water as achieved by the spray nozzle 40. In other words, a mist of water is introduced into a pressurized carbon dioxide environment such that the water quickly entrains the carbon dioxide toward a saturation level.

With specific reference now to the pneumatic pump 24, it can be seen that the same includes a top sensor 42, a lower sensor 44, and a ground pin 46. Indeed, the sensors 42,44 may simply comprise metallic pins. The pins 42,44,46 all communicate with a logic circuit 48. The logic circuit 48 senses communication via the precarbonated water within the reservoir of the pump 24 between the top sensor 42 and the ground pin 46 and the bottom sensor 44 and the ground pin 46. The pin 42 is maintained at the upper most portion of the reservoir of the pump 24 and, when the precarbonated water reaches this pin, electrical conduction is achieved between the pin 42 and ground 46, indicating to the logic circuit 48 that a full volume of a water is retained within the reservoir. In contradistinction, should the water level fall below the pin 44, such that conduction is no longer achieved between the pins 44 and 46, the logic circuit 48 determines that a low volume of water is maintained within the reservoir of the pump 24 and the reservoir 24 is allowed to replenish itself to the level of the pin 42 in a manner to be discussed hereinafter.

It will be appreciated that the logic circuit 48 controls the three-way valve 26 to achieve replenishment of the reservoir of the pump 24 and pressurization of such pump in a manner which will also be discussed hereinafter. It should be noted at this time that an exhaust vent 50 is provided in association with the three-way valve 26 to allow for such replenishment.

It will be noted that various pipes or conduits of the system have been designated with respective numerals 52–60. These conduits interconnect the various elements just discussed. The numerical designations just identified will assist in the description presented directly below.

In operation, the source of pressurized carbon dioxide 14 provides a pressure head to the tank 16 through the conduits 56, 58, 60 and the check valve 30. Again, it should be recalled that the check valve 30 is effective to drop the pressure to the tank 16 by a finite amount. In the preferred embodiment, the pressure from the source 14 is at 100 psi with the resultant pressure provided through the conduit 60 being on the order of 80 psi. The 100 psi of carbon dioxide gas is also provided through the conduit 56, check valve 28, and three-way valve 26 to the top of the pneumatic pump 24. Accordingly, the water within the reservoir of the pump 24 has thereon a pressure head of 100 psi carbon dioxide gas. With the pump 24 being a small volume unit on the order of 100–500 ml, the water within the reservoir is substantially precarbonated. The 100 psi pressure head urges the precarbonated water from the reservoir of the pump 24 through the conduit 36, check valve 34, conduit 38, and out of the spray nozzle 40. The tank 16 will continue to fill with the carbonated water, with the pressure head in the tank 16 increasing as the volume of carbonated water increases and, accordingly, the volume of the pressure head decreases. At some level, the system will stabilize such that the pressure in the tank 16 is at 100 psi, preventing any further spray of precarbonated water from the nozzle 40.

As the system 10 sets at rest, the soda in the carbonation tank 16 continues to absorb carbon dioxide gas under the pressure head. At the same time, precarbonated water continues to spray from the nozzle 40. This process continues until a point of equilibrium is reached where the water (soda) in the tank 16 has absorbed or entrained its maximum capacity of carbon dioxide gas at the preferred head pressure of 100 psi. At that point, the flow of precarbonated water through the nozzle 40 will terminate awaiting a subsequent dispensing cycle. The point of equilibrium will typically occur short of the tank 16 being completely filled with soda, generally when the tank is 75–90% full. However, even if the tank 16 fills completely, a 100 psi head of carbon dioxide gas is assured via the pump 24, conduits 36,38 and check valve 34 to obtain full carbonation.

As soda is taken from the head 22 via the valve 20, the volume of soda in the reservoir 16 will decrease such that the pressure will also decrease, but never below the 80 psi provided through the cracking check valve 30. This 80 psi pressure head is sufficient to obtain a constant and reliable soda flow through the dispensing head 22. Since the pressure in the pneumatic pump 24, on the order of 100 psi, is far greater than that from the water supply 12, replenishment of the tank 16 is always with the precarbonated water from the reservoir of the tank 24 through the check valve 34 and conduit 38. Accordingly, the amount of carbonation required to fully carbonate the water and soda is minimized and the efficiency thereof is maximized by the spraying effect.

As the level of the precarbonated water in the reservoir of the pump 24 drops, it will eventually drop below the low level sensor 44. At this time, the logic circuit 48 determines that the pump 24 must be replenished. Accordingly, the logic circuit 48 causes the three-way valve 26 to switch such that the pump 24 is vented through the exhaust 50 to atmosphere and the passing of pressurized carbon dioxide gas from the source 14 to the pump 24 is terminated. The low pressure of the water source 12 then causes water to flow through the conduit 52, check valve 32, and conduits 54,36 into the bottom of the reservoir of the pump 24. The water continues to fill until contact is made with the upper level sensor 42, indicating that a full volume of water is present in the pump 24. With conduction being complete between the pins 42,46, the logic circuit 48 determines that replenishment is complete and switches the valve 26 to close the exhaust vent 50 and again allow pressurization of the pump 24 via the pressurized source of carbon dioxide 14. The pump 24 is thus again able to provide precarbonated water to the tank 16 through the spray nozzle 40.

It is preferred that the exhaust vent 50 include a cracking pressure check valve to assure that the head on the pump 24 is not totally dissipated during the replenishment cycle. The characteristic cracking pressure of such valve would typically be slightly less than the pressure head at the water source 12 so that replenishment could occur. In a preferred embodiment, the cracking pressure of the valve will be 50–90% of the pressure head at the source 12. By way of example, if the water source 12 operates under a pressure head of 80 psi, by selecting a valve at the exhaust vent 50 having a characteristic cracking pressure of 60 psi, replenishment will occur under an effective pressure head of 20 psi. This 20 psi head will be sufficient to effect replenishment while conserving the carbon dioxide gas of a 60 psi head in the pump 24 such that repressurization of the pump may be efficiently and economically realized when the replenishment cycle is completed and the three-way valve 26 is activated to close the exhaust 50 and reconnect the carbon dioxide gas pressure source 14 with the pump 24.

It will be appreciated that replenishment of the pump 24 may be made even during a dispensing cycle via the valve 20 and dispensing head 22. When the pump 24 is vented to atmosphere, the pressure head remains in the tank 16 by virtue of the check valve 34 and communication from the pressurized source of carbon dioxide 14 through the check valve 30. Accordingly, there is always a minimum of 80 psi available to achieve dispensing, irrespective of the mode of operation of the pump 24.

It will be appreciated by those skilled in the art that the various check valves 28,30,32,34 all serve to prevent the backflow of water, gas, or pressure during the operational sequence described above.

It should now be apparent to those skilled in the art that the instant invention provides a carbonation system which incorporates a precarbonation chamber and a pneumatic pump to maximize the efficiency of the carbonation process while minimizing the cost of manufacture, operation and maintenance of the same. There is no longer a need for a high pressure electric pump for transporting water from a house supply of water to the carbonation tank. The system is totally pneumatic, operating from the pressure of the gas which achieves the carbonation itself. Accordingly, the water to the carbonation tank is substantially carbonated when it reaches the tank and the soda within the tank reaches a physical level which is an equilibrium with a pressure head upon the soda to effect and maintain optimum carbonation. Indeed, the system just described is so simple in operation and inexpensive to construct and maintain that residential carbonation systems of this nature can readily be employed on a cost-effective basis.

Thus it can be seen that the objects of the invention have been satisfied by the structure presented hereinabove. While in accordance with the patent statutes, only the best mode and preferred embodiment of the invention has been presented and described in detail, it is to be understood that the invention is not limited thereto or thereby. Accordingly, for an appreciation of the true scope and breadth of the invention, reference should be had to the following claims.

What is claimed is:

1. A carbonation system for generating soda, comprising:

a source of carbon dioxide maintained under pressure;

a source of water;

a reservoir in communication with said source of carbon dioxide and said source of water, said reservoir receiving a volume of water from said source of water and a first pressure head of carbon dioxide gas from said source of carbon dioxide; and a carbonation tank in communication with said source of carbon dioxide and said reservoir, said carbonation tank receiving a second pressure head of carbon dioxide gas from said source of carbon dioxide and a flow of water from said reservoir, said flow of water increasing said second pressure head of said carbonation tank until said second pressure head equals said first pressure head, terminating said flow of water.

2. The carbonation system according to claim 1 wherein said first pressure head provided to said reservoir by said source of carbon dioxide is greater than said second pressure head provided to said carbonation tank by said source of carbon dioxide.

3. The carbonation system according to claim 2 which further comprises pressure reduction means interposed between said source of carbon dioxide and said carbonation tank for reducing said pressure from said source of carbon dioxide to said carbonation tank.

4. The carbonation system according to claim 3 wherein said pressure reduction means comprises a check valve having a finite characteristic cracking pressure.

5. The carbonation system according to claim 1 wherein said reservoir comprises a pneumatic pump activated to commence and terminate said flow of water as a function of comparative amplitudes of said first pressure head of said pneumatic pump and said second pressure head of said carbonation tank.

6. The carbonation system according to claim 5 which further comprises valve means interposed between said reservoir and said source of carbon dioxide for selectively interrupting communication of said reservoir with said source of carbon dioxide and venting said reservoir to atmosphere.

7. The carbonation system according to claim 6 wherein said reservoir includes sensing means for monitoring changes in said volume of water in said reservoir.

8. The carbonation system according to claim 7 wherein said sensing comprises first and second sensors within said reservoir, said first sensor positioned at a first level indicating said reservoir is full, and said second sensor positioned at a second level indicating said reservoir requires replenishment of water.

9. The carbonation system according to claim 8 which further comprises control means, interconnected between said first and second sensor and said valve means, for activating said valve means to vent said reservoir to atmosphere when said second sensor indicates that water in said reservoir is at said second level to replenish said reservoir to said first level, and subsequently interconnecting said source of carbon dioxide to said reservoir when said first sensor indicates that water in said reservoir is at said first level.

10. The carbonation system according to claim 9 wherein said pressure head of carbon dioxide in said reservoir is greater than any pressure head associated with said source of water.

11. The carbonation system according to claim 10 which further comprises a first check valve interposed between said source of water and said reservoir, a second check valve interposed between said reservoir and said carbonation tank, and a third check valve interposed between said source of carbon dioxide and said reservoir.

12. The carbonation system according to claim 1 wherein said carbonation tank comprises a spray nozzle at a top end thereof and in communication with said reservoir for spraying water into said carbonation tank from said reservoir.

13. A carbonation system for connection to a source of water, comprising:

a source of carbon dioxide maintained at a pressure;

a pneumatic pump in communication with the source of water and receiving water therefrom, and in communication with said source of carbon dioxide and receiving a first pressure head being greater than any pressure head associated with the source of water; and a carbonation tank in communication with said source of carbon dioxide and receiving a second pressure head of carbon dioxide gas therefrom, and in communication with said pneumatic pump and receiving water therefrom, said carbonation tank receiving and maintaining a sufficient volume of water therein to equalize said first and second pressure heads.

14. The carbonation system according to claim 13 wherein said first pressure head provided by said source of carbon dioxide gas is greater than said second pressure head provided by said source of carbon dioxide gas, said first pressure head being applied directly to a surface of water received within said pump for carbonating said water.

15. The carbonation system according to claim 14 which further comprises a spray nozzle in said carbonation tank within said second pressure head, said spray nozzle spraying water into said carbonation tank from said pneumatic pump.

16. The carbonation system according to claim 13 which further comprises valve means interconnected between said source of carbon dioxide and said pneumatic pump for selectively interconnecting said pneumatic pump to said source of carbon dioxide and venting said pneumatic pump to atmosphere.

17. The carbonation system according to claim 16 which further comprises control means interconnected between said pneumatic pump and said valve means for venting said pneumatic pump to atmosphere when water in said pneumatic pump is at a first lower level and subsequently terminating said venting to atmosphere and causing said pneumatic pump to communicate with said source of carbon dioxide when said water in said pneumatic pump reaches a second higher level.

18. The carbonation system according to claim 13 which further comprises a dispensing conduit in communication with said carbonation tank.

19. The carbonation system according to claim 18 which further comprises a dispensing valve interposed in said dispensing conduit and ahead of a dispensing head.

20. The carbonation system according to claim 13 which further comprises an exhaust vent in communication with said pneumatic pump, said exhaust vent having a valve therein with a characteristic cracking pressure less than any pressure head associated with the source of water.

* * * * *